US007572147B1

(12) United States Patent
Wierzbicki et al.

(10) Patent No.: US 7,572,147 B1
(45) Date of Patent: Aug. 11, 2009

(54) LINE CORD FILTER

(75) Inventors: Robert P. Wierzbicki, Worcester, MA (US); Keith Johnson, Medway, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 12/147,513

(22) Filed: Jun. 27, 2008

(51) Int. Cl.
*H01R 13/648* (2006.01)

(52) U.S. Cl. ..... 439/607.06; 439/638

(58) Field of Classification Search ..... 439/607, 439/608, 638, 651, 214, 215, 456–458, 607.05–607.07
See application file for complete search history.

(56) References Cited

U.S. PATENT DOCUMENTS 5,085,596 A * 2/1992 Bowen et al. ..... 439/608
6,190,206 B1 * 2/2001 Yang ..... 439/608
6,491,545 B1 * 12/2002 Spiegel et al. ..... 439/608
6,814,620 B1 * 11/2004 Wu ..... 439/608
2007/0004282 A1 * 1/2007 Cohen et al. ..... 439/608

* cited by examiner

*Primary Examiner*—Felix O Figueroa

(57) ABSTRACT

A line cord filter assembly for providing EMI shielding includes at a first end thereof a first plug for connecting to a power source external of a chassis and having at a second end thereof a second plug for connecting to electronic components disposed internally of the chassis. An elongated electrically conductive block has a serpentine shaped channel disposed in an inner surface thereof and extending between the first end and the second end. A electrical cable is disposed in the channel, having an inner electrical conductor and an outer electrical insulator, the electrical conductor electrically connected to the first end and the other end of the electrical conductor electrically connected to the second end. An electrically conductive, deformable sheet is disposed on the electrically conductive block over the outer electrical insulator with portions of the sheet projecting into portions of the channels around portions of the outer electrical insulator disposed within the channel.

5 Claims, 10 Drawing Sheets

LINE CORD FILTER

CROSS-REFERENCE TO RELATED APPLICATIONS

This application relates to U.S. patent application Ser. No. 11/540,472, filed Sep. 29, 2006, the entire subject matter thereof being incorporated herein by reference.

TECHNICAL FIELD

This invention relates generally to line cord filters.

BACKGROUND

As is known in the art, Electromagnetic interference (EMI) is created from everyday natural sources. Additionally there are innumerable sources of man made EMI typically created and radiated by televisions, power transmission lines, ignition systems, fluorescent lightning, radar transmissions, electric car chargers, and computing devices. These sources of EMI radiation challenge the equipment, designers, and engineers to find a solution to keep electronic signals coming to equipment clean and usable, isolated from the negative effects of the ever present EMI.

EMI filters, which are electronic devices having suitable capacitive and inductive characteristics for reducing the onerous EMI, are commonly installed in electronic circuits to achieve this goal. Filters for the application of interest here are commonly fabricated by prior art methods and typically consist of a discoidal capacitor, feed through filter in a bulk head mount configuration that is placed in a signal path to redirect electromagnetic interference back to its source.

Feed through filters of this type consists of either a capacitor (C-only) or a combination of capacitive and inductive elements arranged in classic filter configurations (LC, Pi, or T). Each of these configurations fits a particular application requirement. The most economical solution is to select the filter with the fewest internal parts that achieves the desired filtering effect.

C-only filters, i.e., filters that consist solely of capacitive elements, can be well-suited for filtering high frequency signals on lines with very high impedance. In at least some practical cases, the attenuation of these devices increases in steps of 20 dB per decade from the filter's cutoff frequency up to the frequency where they reach an attenuation of at least 60 dB. (There are many C filters that provide less performance in practical applications. Many physically-realizable filters cannot achieve 60 dB attenuation.)

The LC type filter can be well-suited for applications in which there are large differences between line and load impedances. (Note that effective LC filters can also be built where both source and load impedances are identical.) These devices consist of a capacitive element, in the same manner as the C-only filter, with the addition of an inductive element connected in series with the capacitor between the input and output terminals. Usually, it is best to install the filter so that the inductive element faces the lower impedance terminal. With respect to the conventional packaging of discoidal capacitor type filters, this means that in some applications it is desirable to have the capacitive element close to the threaded or screw-neck header end of the filter package, while in other cases the reverse is desirable, with the inductive element located on the threaded or screw-neck end.

Unlike conventional leaded capacitors, the discoidal capacitor's co-axial configuration provides at least two advantages. It prevents radiation present at the input end from coupling directly to the capacitor output. This construction also has inherently low self- and mutual inductance and the combination provides excellent shunting of EMI at frequencies approaching 1 GHz. The addition of inductive elements (wire wound coils, toroids or beads) in series with the capacitor increases the impedance of the line, making the filter even more effective.

Pi filters consist of three elements. A series inductive element is positioned between two capacitors which are shunt connected one across the source and one across the load. Pi filters are well-suited for applications where the input and the output impedances are of relatively high value and high levels of attenuation are required. In at least some practical cases, these filters may increase attenuation by 60 dB per decade from the filter cutoff frequency to the frequency where the filter exhibits an attenuation of at least 80 db (The capacitors in a Pi filter work by providing a large impedance mismatch relative to the (higher) source and load impedance in the application circuit. There is no requirement that the source and load impedances be similar for a Pi filter to function effectively. Note also that 80 dB attenuation is not an intrinsic property of a Pi filter; many physically realizable filters do not achieve an attenuation approaching 80 dB.)

The T filter is also a three-element device, but this time there are two series inductors connected between the input and output terminals on each side of a single capacitor which is shunt connected across the signal and its return conductors. In at least some practical cases, the T filter performs in much the same manner as a Pi filter, increasing attenuation in steps of 60 dB per decade from the cutoff frequency to the frequency where the attenuation is at least 60 dB. This filter type is selected when both the input and output impedances are low.

Internally the most complicated device, the LL filter consists of two feed through capacitors connected between line and ground interspersed with two inductors connected in series between the input and output terminals. In at least some practical cases, these filters increase in attenuation in steps of 80 dB per decade from the cutoff frequency to the frequency where the attenuation is at least 80 db. (Note also that 80 dB attenuation is not an intrinsic property of an LL filter; many physically realizable filters do not achieve an attenuation approaching 80 dB.)

Today, most center through-feed, metal enclosure, metal housing, bulkhead or through hole mounted EMI filters for low frequency, high current applications employ at least one discoidal capacitor element, and commonly use X7R ceramic formulations for the capacitor dielectric. It can be cost-effective and has an adequate dielectric constant at normal operating temperatures.

In particular, at least one type of C-only feed through filter uses a feed through capacitor that mounts into an opening of an enclosure wall and is secured by soldering or mechanical means. A conductor passes through the center of the capacitor and the electrical signal is filtered by the capacitor. The noise currents are shunted to the enclosure through the dielectric material of the feed through capacitor. If multiple conductors are needed, multiple feed through capacitors are used.

In one or more enclosures, a typical data storage system includes data moving circuitry and an array of disk drives. Some data storage systems fit within standard-sized equipment cabinets or racks. The data moving circuitry for such data storage systems is typically fashioned into modules called blade servers, or simply blades, which are housed (perhaps in pairs) within enclosures. Such enclosures are commonly available in a variety of standard heights (e.g., 4 U, 3 U, 2 U and 1 U, where U is a standard measure of vertical height in the equipment cabinet and is equal to 1.75 inches in accordance with the EM-310-D industry standard).

One conventional enclosure (hereinafter referred to as the conventional 4 U enclosure) includes a 4 U chassis, a midplane, two independent blades, two dual-port power supplies, and three pairs of fans. The midplane sits in the middle of the 4 U chassis. The two blades independently plug into the midplane through a rear opening of the 4 U chassis and reside in a stacked manner within the 4 U chassis, one above the other. Similarly, the dual-port power supplies independently plug into the midplane through the rear opening of the 4 U chassis and straddle the two blades along the sides of the 4 U chassis. In particular, a rightside power supply sits right side up within the 4 U chassis, and a leftside power supply sits upside down within the 4 U chassis, thus enabling the manufacturer to connect both dual-port power supplies to the midplane while maintaining a single dual-port power supply design for the 4 U chassis. One power cord to each dual port power supply plugs into the rear face of the power supply through an IEC-C14 appliance coupler mounted on each power supply. Additionally, each pair of fans plugs into the midplane through a front opening of the 4 U chassis.

During operation, the midplane carries DC power supply signals from the two dual-port power supplies to the three pairs of fans and to the two blades (i.e., a first port of each dual-port power supply outputs power supply signals to one blade and a second port of each dual-port power supply outputs power supply signals to the other blade). The power for both the fans and the blades is diode-OR'd or shared to support backup of each other in the event of one DC power supply failing. Each blade of the 4 U enclosure typically includes two microprocessors and performs data storage operations. For example, each blade stores data into and retrieves data from an adjacent array of disk drives on behalf of one or more external host computers. The three pairs of fans pass air over the blades in a shared configuration to thermally maintain the blades within a controlled temperature range.

SUMMARY

In accordance with the present invention, a line cord filter assembly for providing EMI shielding is provided having at a first end thereof a first plug for connecting to a power source external of a chassis and having at a second end thereof a second plug for connecting to electronic components disposed internally of the chassis. The filter assembly includes an elongated electrically conductive block having a serpentine shaped channel disposed in an inner surface thereof, such channel extending between the first end and the second end. The assembly includes a electrical cable disposed in the channel, such cable having an inner electrical conductor and an outer electrical insulator, the electrical conductor being electrically connected to the first end and the other end of the electrical conductor being electrically connected to the second end. The assembly also includes an electrically conductive, deformable sheet disposed on the electrically conductive block over the outer electrical insulator with portions of the sheet projecting into portions of the channels around portions of the outer electrical insulator disposed within the channel.

In one embodiment, the line cord filter assembly includes a second elongated electrically conductive block disposed on the electrically conductive, deformable sheet.

In one embodiment, the second elongated electrically conductive block has a second serpentine shaped channel disposed in an inner surface thereof, such second channel extending between the first end and the second end.

In one embodiment, a second electrical cable disposed in the second channel, such second cable having an inner electrical conductor and an outer electrical insulator, the electrical conductor thereof being electrically connected to the first end and the other end of the electrical conductor thereof being electrically connected to the second end.

In one embodiment the electrically conductive, deformable sheet is disposed on the second electrically conductive block over the outer electrical insulator with portions of the sheet projecting into portions of the second channels around portions of the outer electrical insulator of the second cable disposed within the second.

In one embodiment, the filter assembly includes a second electrically conductive, deformable sheet disposed between an outer surface of the first-mentioned block and an inner wall of the chassis.

In one embodiment, the chassis is grounded.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 4' is a cross sectional view of the view of the line cord filter assembly of FIG. 2, such cross sectional being taken along line 4-4 in FIG. 2, and a chassis to which the filter assembly of FIG. 4 is mounted, such view being after final assembly of the filter assembly;

FIG. 5' is a cross sectional view of an exemplary one of a plurality of electrical cables used in the line cord filter assembly of FIG. 1;

Like reference symbols in the various drawings indicate like elements.

DETAILED DESCRIPTION

Figure 1:
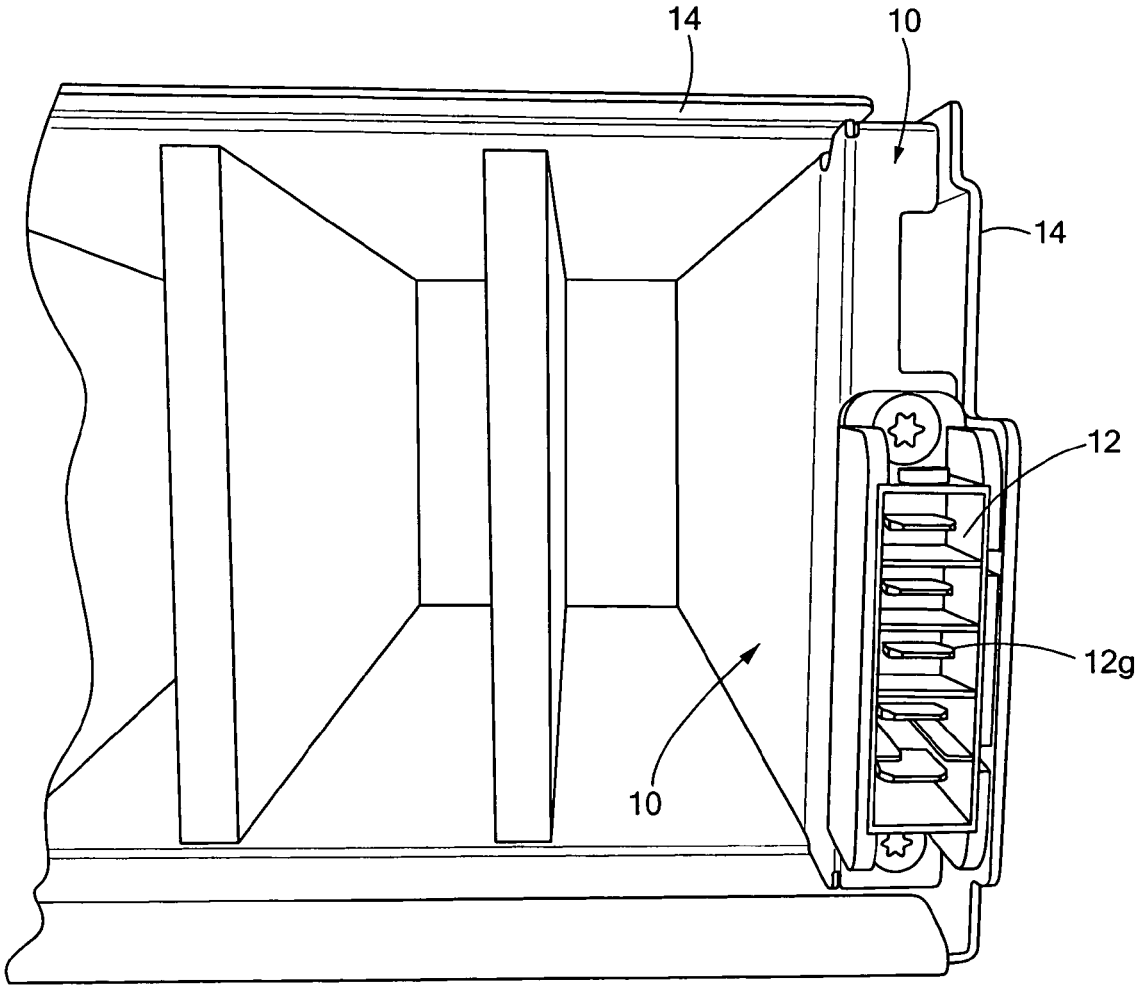
FIG. 1 is a front perspective view of a chassis having a line cord filter assembly according to the invention.
Figure 2:
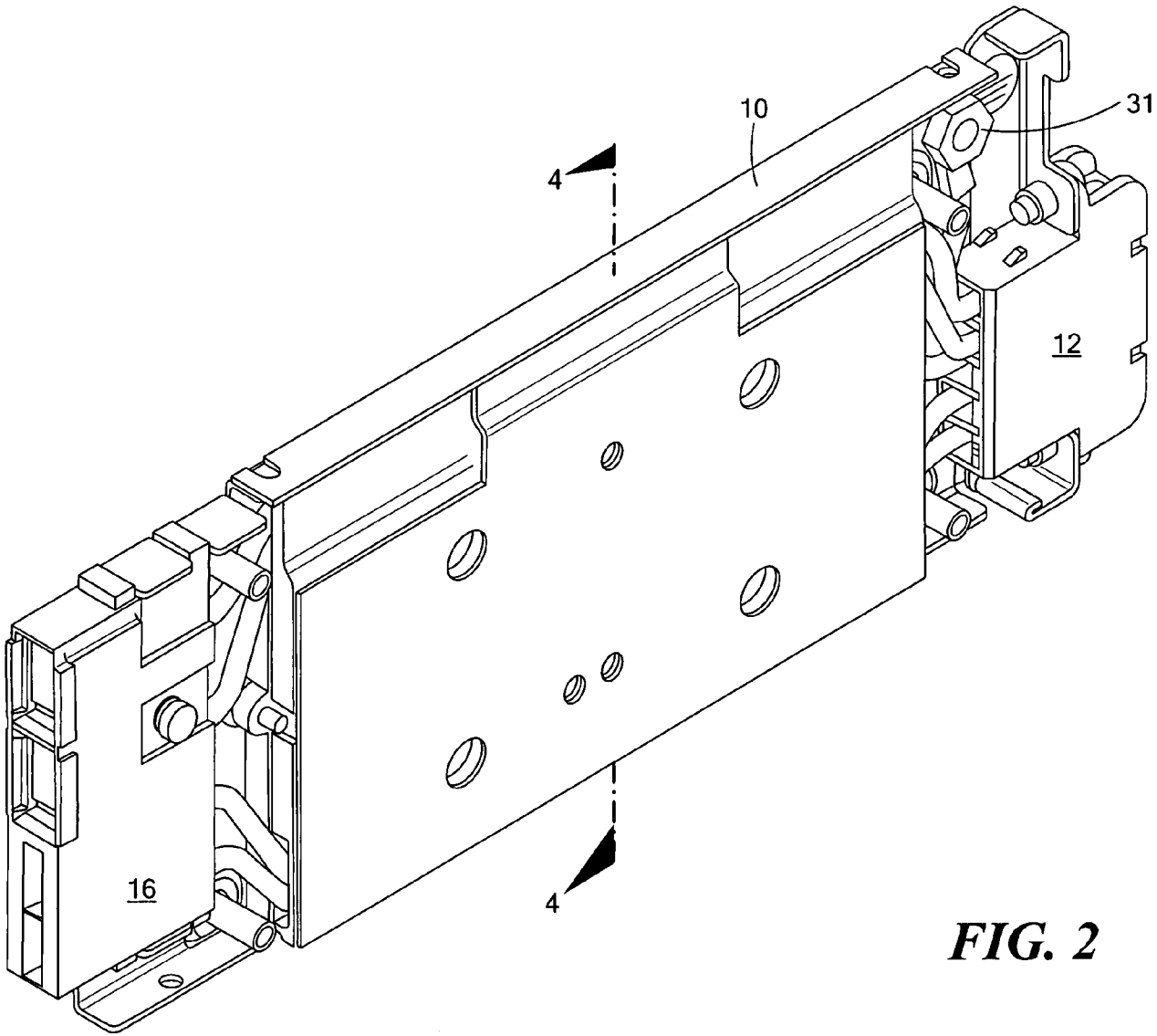
FIG. 2 is a side perspective view of the line cord filter assembly of FIG. 1.
Figure 3:
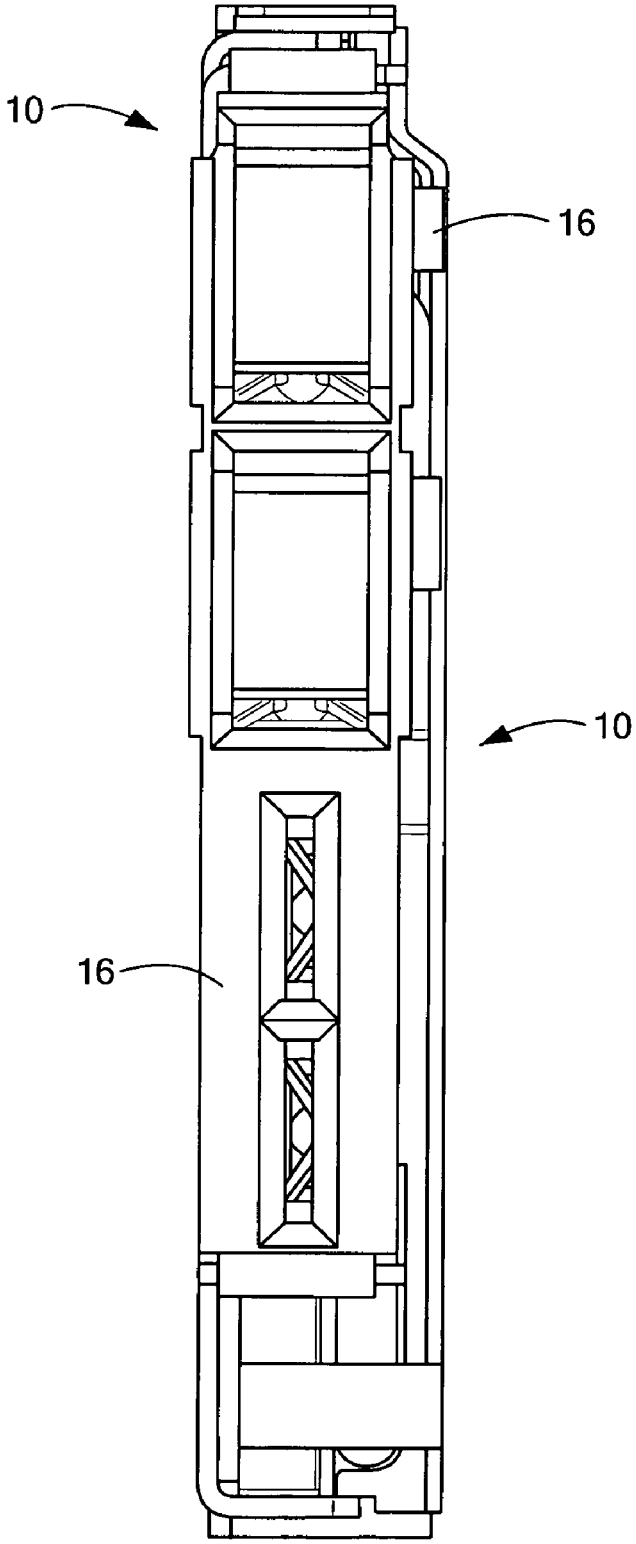
FIG. 3 is an end view of the line cord filter assembly of FIG. 1 viewed from internally of the chassis outward of the chassis.

Referring now to FIG. 1, a line cord filter assembly 10 is shown for providing EMI filtering and chassis shielding. The line cord filter assembly 10 has at a first end thereof a first plug 12 for connecting power from a power source (not shown)

external of a chassis 14 and having at a second end thereof a second plug 16 (FIGS. 2 and 3) for connecting to electronic components (not shown) disposed internally of the chassis 14. It is noted that pin 12*g* is a ground pin and is electrically connected to the conductive housing of the filter assembly 10 via bolt 31, as shown in FIGS. 1, 2, 6 and 7, and thus, when mounted to the chassis 14, to chassis ground.

Figure 8:
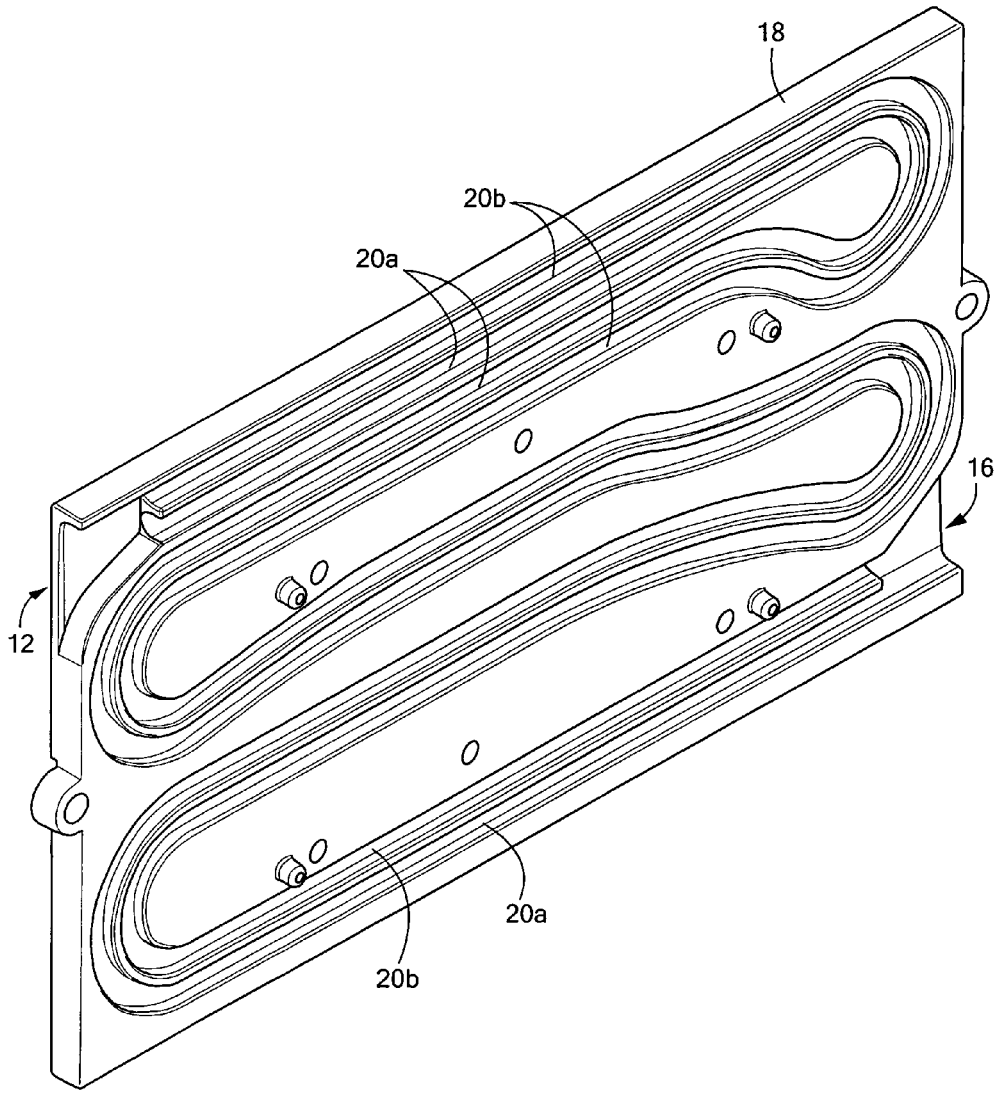
FIG. 8 is a side perspective view of one of a pair of the electrically conductive blocks used in the filter assembly of FIG. 2.

The filter assembly 10 includes an elongated electrically conductive block 18 (FIGS. 4, 4', 5, and 8) having a pair of serpentine shaped channels 20*a*, 20*b* disposed in an inner surface thereof, such channels 20*a*, 20*b* extending between the first end 12 and the second end 16, as indicated in FIG. 8.

Figure 5:
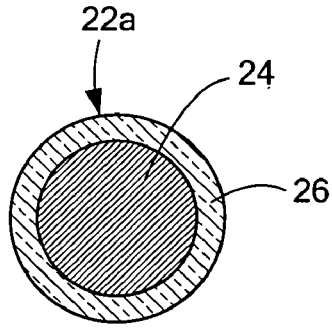
FIG. 5 is an exploded cross sectional view of the view of the line cord filter assembly of FIG. 2 and a chassis to which the filter assembly of FIG. 2 is mounted.
Figure 5:
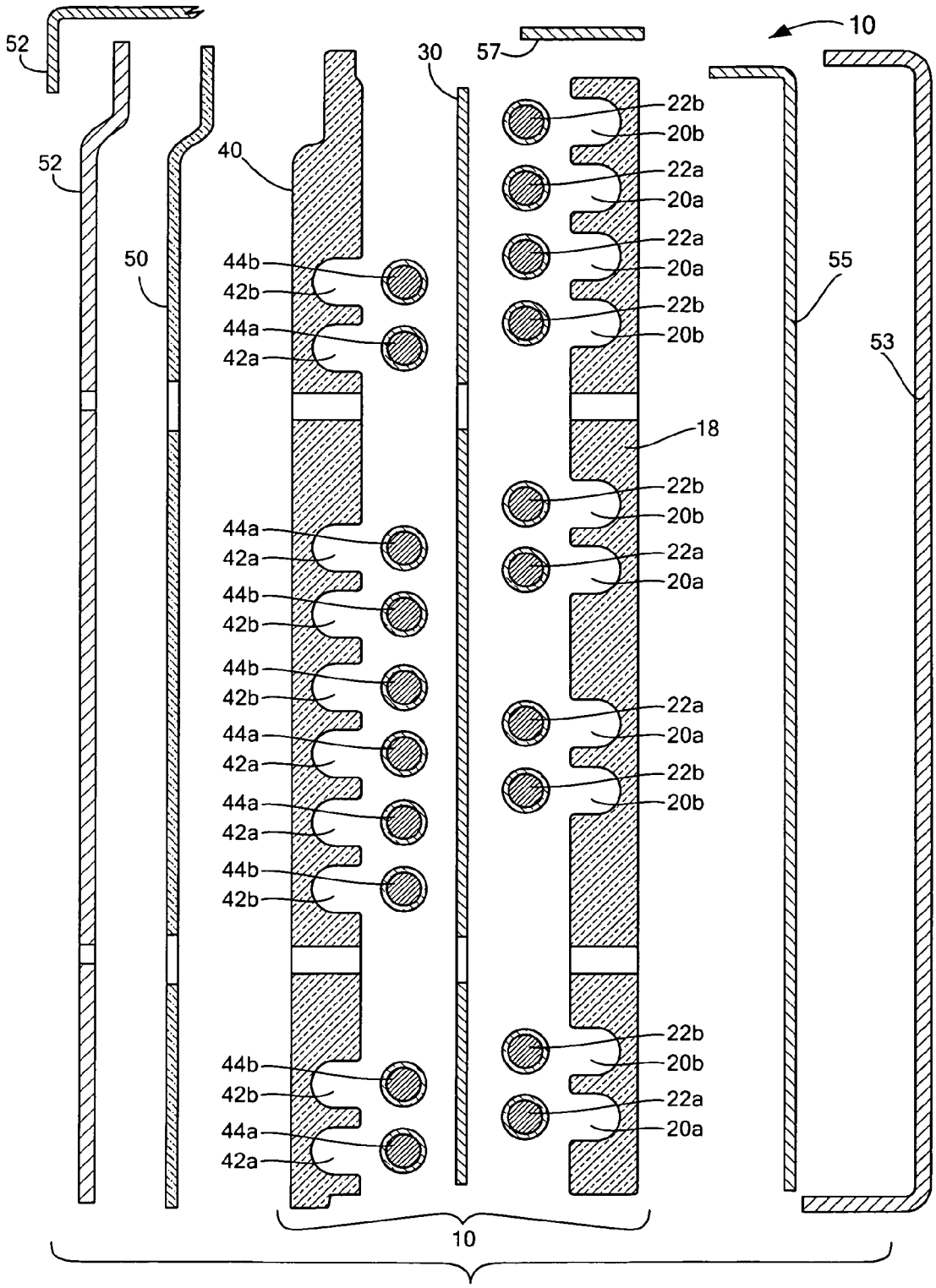
Figure 6:
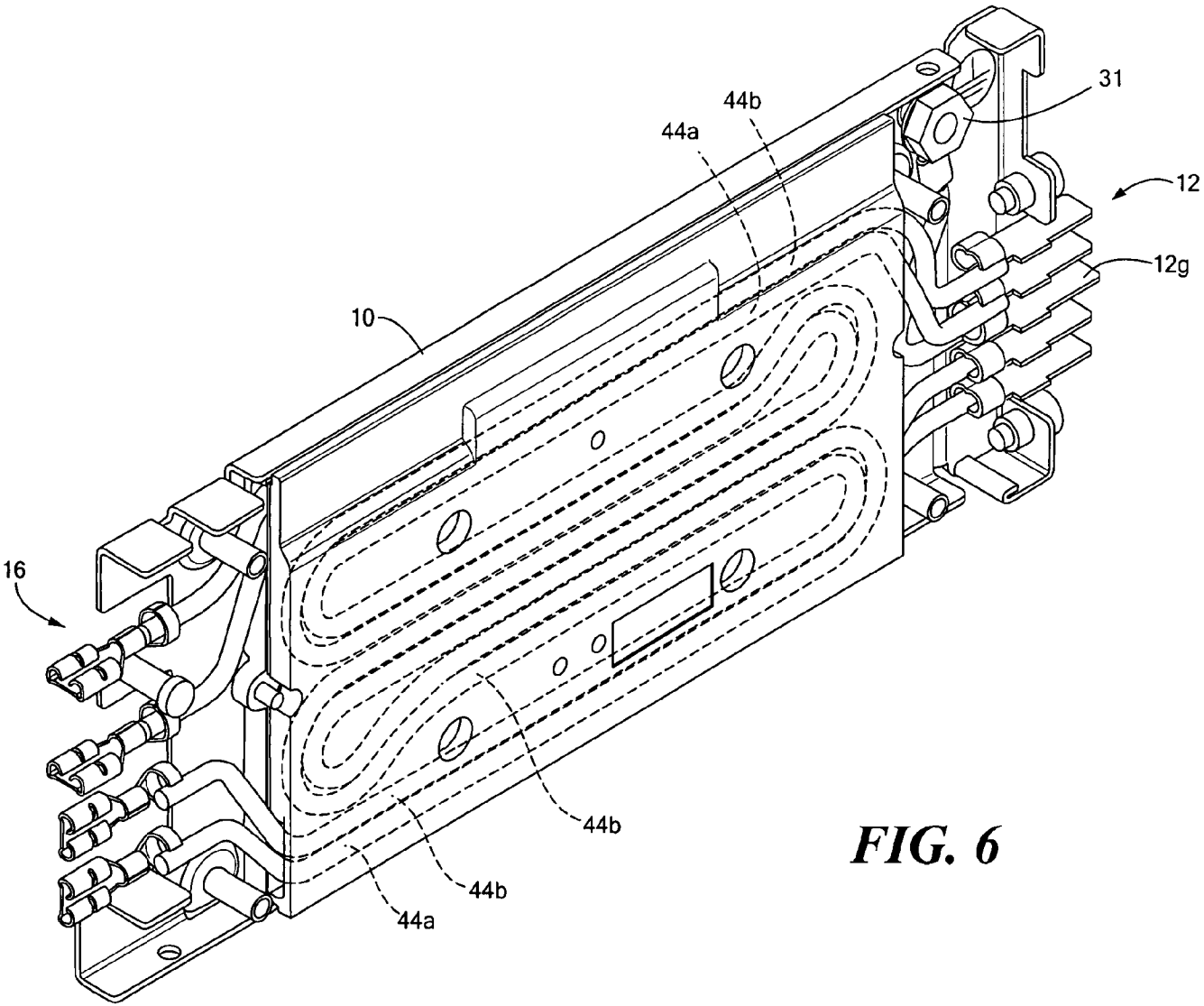
FIG. 6 is a side perspective view of the line cord filter assembly of FIG. 1 with covers of a pair of electrical plugs used therein removed.
Figure 7:
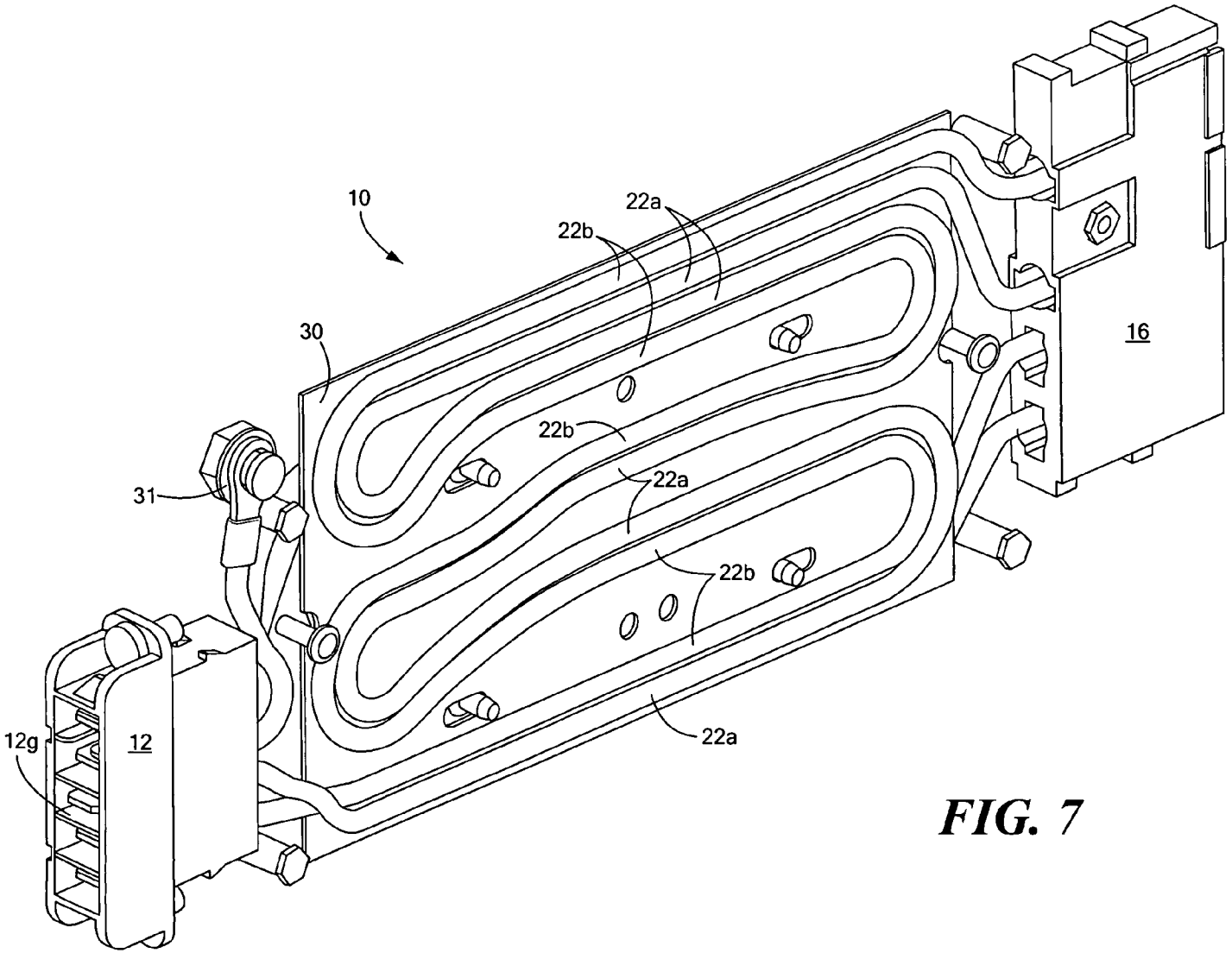
FIG. 7 is a side perspective view of the line cord filter assembly of FIG. 1 with one of a pair of electrically conductive blocks used therein removed.

The assembly 10 includes a pair of electrical cables 22*a*, 22*b* (here, for example, here 12 AWG) each one being disposed in a corresponding one of the pair of channels 20*a*, 20*b*, respectively, such cables 22*a*, 22*b* each having an inner electrical conductor 24 and an outer electrical insulator 26, as shown in FIG. 5' for an exemplary one of the cables 22*a*, 22*b*, here cable 22*a*. The electrical conductors 24 are electrically connected to the plugs 12, 16 (FIGS. 1, 2 and 3 and 8).

Figure 4:
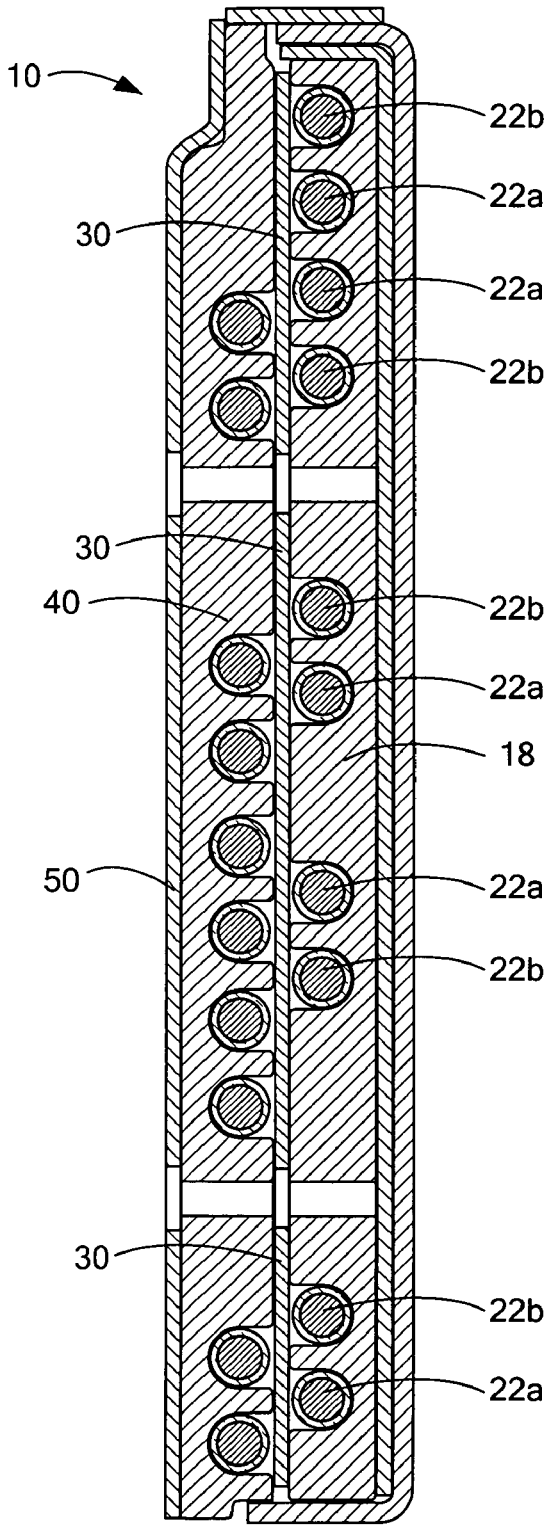
FIG. 4 is a cross sectional view of the view of the line cord filter assembly of FIG. 2, such cross sectional being taken along line 4-4 in FIG. 2, such view being prior to final assembly of the filter assembly.
Figure 4:
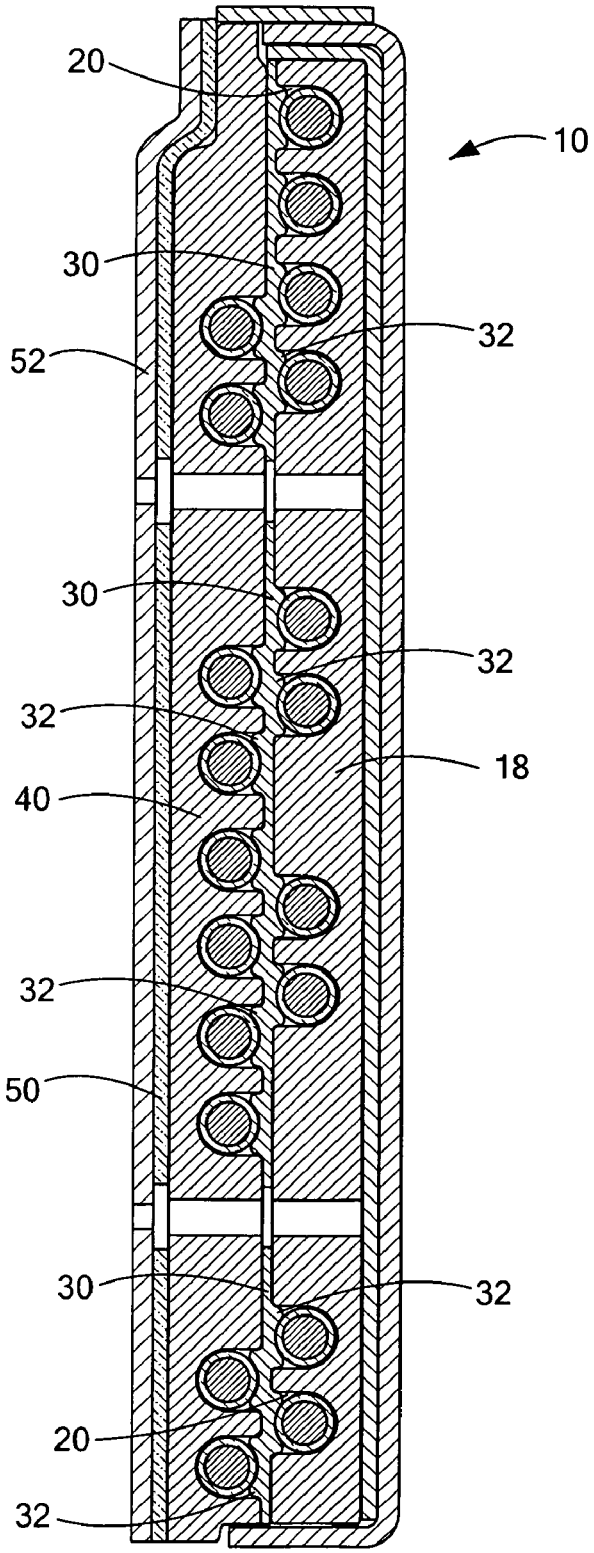

The assembly 10 also includes an electrically conductive, deformable sheet (EMI shielding gasket) 30 (FIGS. 4, 4', 5, and 7), disposed on the electrically conductive block 18 over the outer electrical insulator 26 with portions 32 of the sheet 30, after assembly, as shown in FIG. 4', projecting into portions of the channels 20*a*, 20*b* around portions of the outer electrical insulator 26 disposed within the channel 20*a*, 20*b*.

Figure 9:
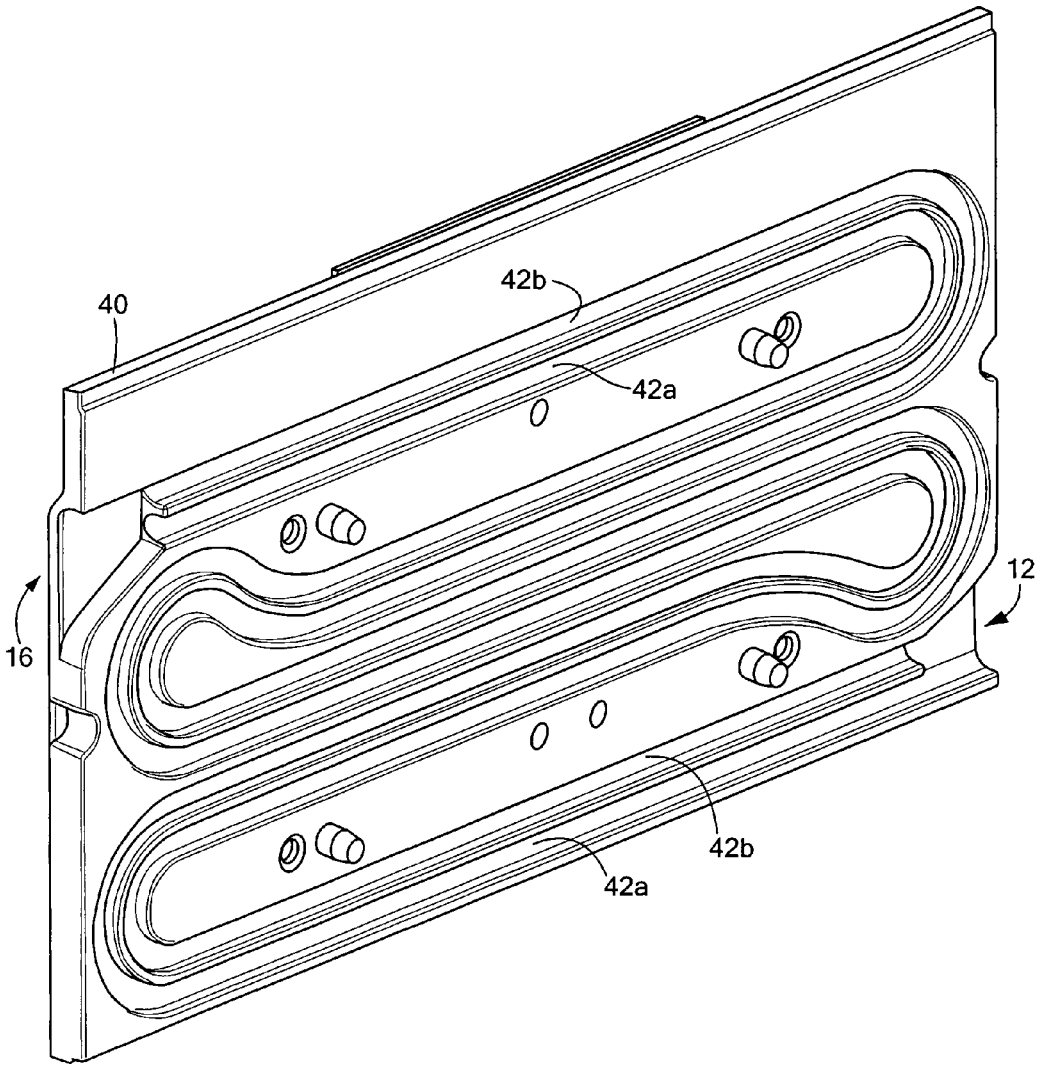
FIG. 9 is a side perspective view of a second one of a pair of the electrically conductive blocks used in the filter assembly of FIG. 2.

The line cord filter assembly 10 includes a second elongated electrically conductive block 40 (FIGS. 4, 4', 5 and 9) disposed on the electrically conductive, deformable sheet 30. The second elongated electrically conductive block 40 has a pair of second serpentine shaped channels 42*a*, 42*b* disposed in an inner surface thereof, such second channels extending between the first end and the second end 12, 16, as indicated in FIG. 9.

Each one of a pair of second electrical cables 44*a*, 44*b* (here, for example, here 12 AWG) is disposed in a corresponding one of the second channels 42*a*, 42*b*, respectively, such second cables 44*a*, 44*b* having an inner electrical conductor and an outer electrical insulator as the exemplary cable 22*a*, shown in FIG. 5'. The electrical conductors of the cables 44*a*, 44*b* are electrically connected to the plugs 12, 16.

The electrically conductive, deformable sheet 30 is disposed on the second electrically conductive block 40 over the outer electrical insulator with, after assembly, as shown in FIG. 4', portions 32 of the sheet projecting into portions of the second channels around portions of the outer electrical insulator of the second cables.

The filter assembly 10 includes a sheet metal mounting plate 53, and electrically conductive gaskets 55 and 57. When the filter 10 is bolted to the chassis wall 52, the filter become finally assembled. Thus, after final assembly as shown in FIG. 4', the electrically conductive, deformable sheet 30 is sandwiched between the pair of conductive blocks 18, 40 and the cables, as shown in FIG. 4'. After assembly, a second electrically conductive, deformable sheet 50 is disposed between an outer surface of the block 40 and an inner wall 52 of the chassis 14, and the assembly 10 is fastened to the wall 52 of chassis 14 using bolts or rivets or any other convectional means. The chassis is electrically grounded.

Thus, after assembly, there are four 24 inch embedded wires or cables (inside block length) laid into a serpentine set of channels within two cast plates (i.e., blocks 18, 40) separated by a thin highly conductive sheet or gasket 30. Each wire is here 12 AWG. The filter assembly 10 is here 0.480" thin 'installed' and only 3" tall by 5" long. The filter assembly 10 functions longitudinally along the inside face of the outer chassis side wall and returns the EMI noise through very low series inductance path back to it's source through that metal chassis wall. It relies on closely spacing the conductors for long distances (hence the use of serpentine conductors to achieve such long distances) to build capacitive coupling (distributed capacitance) to its metal block. Yet not burden significant amount of volume to accomplish this task. The distance between conductive surfaces is inversely proportional to achieving capacitive coupling and this is very significant.

A number of embodiments of the invention have been described. Nevertheless, it will be understood that various modifications may be made without departing from the spirit and scope of the invention. Accordingly, other embodiments are within the scope of the following claims.

What is claimed is:

1. A line cord filter assembly having at a first end thereof a first plug for connecting to a power source external of a chassis and having at a second end thereof a second plug for connecting to electronic components disposed internally of the chassis, such filter assembly comprising:

an elongated electrically conductive block having a serpentine shaped channel disposed in an inner surface thereof, such channel extending between the first end and the second end;

a electrical cable disposed in the channel, such cable having an inner electrical conductor and an outer electrical insulator, the electrical conductor being electrically connected to the first end and the other end of the electrical conductor being electrically connected to the second end;

an electrically conductive, deformable sheet disposed on the electrically conductive block over the outer electrical insulator with portions of the sheet projecting into portions of the channels around portions of the outer electrical insulator disposed within the channel.

2. The line cord filter assembly recited in claim 1 including a second elongated electrically conductive block disposed on the electrically conductive, deformable sheet.

3. The line cord filter assembly recited in claim 2 wherein:

the second elongated electrically conductive block has a second serpentine shaped channel disposed in an inner surface thereof, such second channel extending between the first end and the second end; and wherein the assembly includes:

a second electrical cable disposed in the second channel, such second cable having an inner electrical conductor and an outer electrical insulator, the electrical conductor thereof being electrically connected to the first end and the other end of the electrical conductor thereof being electrically connected to the second end; and wherein the electrically conductive, deformable sheet is disposed on the second electrically conductive block over the outer electrical insulator with portions of the sheet projecting into portions of the second channels around portions of the outer electrical insulator of the second cable disposed within the second.

4. The line cord filter assembly recited in claim 3 including a second electrically conductive, deformable sheet disposed between an outer surface of the first-mentioned block and an inner wall of the chassis.

5. The line cord recited in claim 4 wherein the chassis is grounded.

* * * * *